US005522702A

United States Patent [19]

Kemsley et al.

[11] Patent Number: 5,522,702

[45] Date of Patent: Jun. 4, 1996

[54] GAS TURBINE ENGINE FAN BLADE ASSEMBLY

[75] Inventors: Nicholas J. Kemsley, Derby; David S. Knott, Loughborough; Kenneth R. Benson, Derby, all of England

[73] Assignee: Rolls-Royce plc, London, England

[21] Appl. No.: 463,523

[22] Filed: Jun. 5, 1995

[51] Int. Cl.[6] ..... F01D 5/32

[52] U.S. Cl. ..... 416.00/2.00; 416/221

[58] Field of Search ..... 416/2, 219 R, 416/220 R, 221

[56] References Cited

U.S. PATENT DOCUMENTS

| | | | |
|---|---|---|---|
| 3,295,826 | 1/1967 | Nickles | 416/221 |
| 3,904,317 | 9/1975 | Cardin et al. | 416/220 R |
| 5,259,728 | 11/1993 | Szpunar et al. | 416/2 |
| 5,350,279 | 9/1994 | Prentice et al. | 416/220 R |

FOREIGN PATENT DOCUMENTS

| | | |
|---|---|---|
| 0083289 | 7/1983 | European Pat. Off. . |
| 0597586 | 5/1994 | European Pat. Off. . |
| 906476 | 9/1962 | United Kingdom . |
| 1523422 | 8/1978 | United Kingdom . |
| 2038959 | 7/1980 | United Kingdom . |

*Primary Examiner*—Edward K. Look
*Assistant Examiner*—James A. Larson
*Attorney, Agent, or Firm*—Cushman Darby & Cushman

[57] ABSTRACT

Each fan blade of a fan blade assembly for a ducted fan gas turbine engine is provided with a key which cooperates with the fan blade root and fan hub to axially lock the fan blade to the fan hub. Each key is deformable under excessive axial loading of its associated fan blade to minimize damage to the fan hub.

7 Claims, 6 Drawing Sheets

GAS TURBINE ENGINE FAN BLADE ASSEMBLY

This invention relates to a ducted fan gas turbine engine fan blade assembly and is particularly concerned with the manner in which the fan blades in such an assembly are locked in position on the rotor disc or hub which carries them.

BACKGROUND OF THE INVENTION

Modern ducted fan gas turbine engines are provided with a front fan which provides both propulsive thrust and a supply of air for the gas generator core of the engine. Typically such fans comprise a hub having a plurality of generally axially extending grooves in its periphery which receive the roots of the fan blades. The grooves and roots are usually of corresponding generally dovetail cross-section shape so as to ensure radial retention of the fan blades.

It is necessary for assembly and maintenance purposes that each of the fan blades should be easily removable from its respective groove in the hub. One way of achieving this is to provide fixed stops at the rearward ends of the hub grooves which the fan blade roots are slid up to. A retention ring is then bolted on to the front of the hub to ensure that forward motion of the roots in their grooves is prevented. While this method of retaining blades is effective for small to medium size engines, it can be less suitable for large engines because of the weight problem associated with a retention ring which is sufficiently robust to ensure effective blade root retention.

An alternative way of retaining fan blades in their slots is described in GB1523422. In that specification, there is described a fan blade assembly in which the fan blades are axially retained by means of a U-shaped bar. The bar locates in appropriate aligned slots in the blade root and hub to provide axial retention. The blade roots and part of the hub rim are partially extended in an upstream direction so as to accommodate the U-shaped bars. A lip provided on a fairing attached to the front face of the hub cooperates with a ring to maintain the U-shaped bars in position.

While such a method of fan blade retention is effective, the extension of the hub rim and blade roots in an upstream direction does give rise to undesirable weight penalties. Moreover it can be difficult to remove a single fan blade for maintenance purposes without disturbing the remaining fan blades. Additionally there can be difficulty in manipulating the U-shaped bars during the installation and removal of the fan blades.

In our co-pending GB patent application no 9223593.6 there is described an improved fan blade retention system. Each fan blade has radial slots in its root portion which are aligned with corresponding slots in the hub groove which receives the fan blade root portion. The aligned slots accommodate a U-shaped key which prevents relative axial movement between each fan blade and the hub.

While this fan blade retention system is highly effective under normal operating conditions, it can sometimes give rise to hub damage in the event of the fan blade being impacted by a foreign object, such as a bird. If a large foreign object impacts a fan blade, the fan blade root portion may move relative to the groove which receives it. This can place shear loads upon the U-shaped key which in turn can cause damage to the fan blade hub. Such fan blade hub damage is unacceptable in view of the stress and fatigue limitations which it places on the disc.

SUMMARY OF THE INVENTION

It is an object of the present invention to provide a gas turbine engine fan blade assembly in which the possibility of such hub damage occurring is substantially reduced.

According to the present invention, a fan blade assembly for a ducted fan gas turbine engine comprises a hub and an annular array of fan blades extending radially outwardly from said hub, said hub having a plurality of generally axially extending grooves in its periphery and each of said fan blades having a root portion which locates in one of said generally axially extending grooves in said hub periphery, each of said fan blade root portions and said hub being provided with generally radially extending slots, each slots in said hub being aligned with a corresponding slot in its associated fan blade root portion, and key means, said key means being located in said aligned slots to limit relative axial movement between each of said fan blade root portions and its corresponding hub groove, each of said key means defining at least one collapsible slit so configured as to collapse under excessive axial loading of its associated fan blade to thereby minimize any relevant damage by said key means to its associated hub slot.

BRIEF DESCRIPTION OF THE DRAWINGS

The present invention will now be described, by way of example, with reference to the accompanying drawings in which.

DETAILED DESCRIPTION

Figure 1:
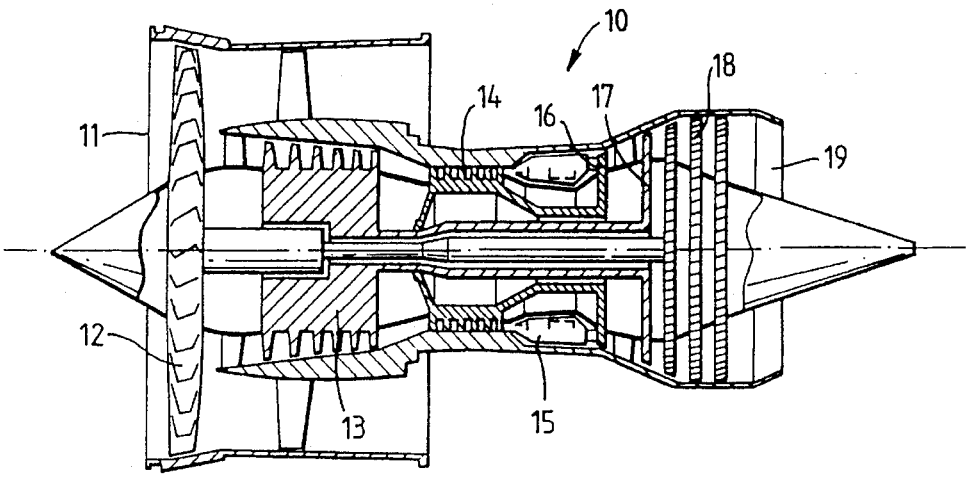
FIG. 1 is a schematic sectioned side view of a ducted fan gas turbine engine having a fan blade assembly in accordance with the present invention.

Referring to FIG. 1, a ducted fan gas turbine engine generally indicated at 10 is of conventional configuration. It comprises an air inlet 11 in which is located a ducted fan blade assembly 12. The fan blade assembly 12 accelerates air drawn in through the inlet 11. That air flow is then divided into two flows. The first flow bypasses the remainder of the engine 10 and provides propulsive thrust. The second flow is directed into an intermediate pressure compressor 13 and subsequently into a high pressure compressor 14 where various stages of compression of the air take place. The compressed air is then directed into a combustor 15 where fuel is mixed with the air and the mixture combusted. The resultant hot combustion products then expand through high, intermediate and low pressure turbines 16,17 and 18 respectively before being exhausted to atmosphere through an exhaust nozzle 19.

The high, intermediate and low pressure turbines 16,17 and 18 respectively drive the high and intermediate pressure compressors 14 and 13 and the ducted fan blade assembly 12 by appropriate coaxial shafts.

Figure 2:
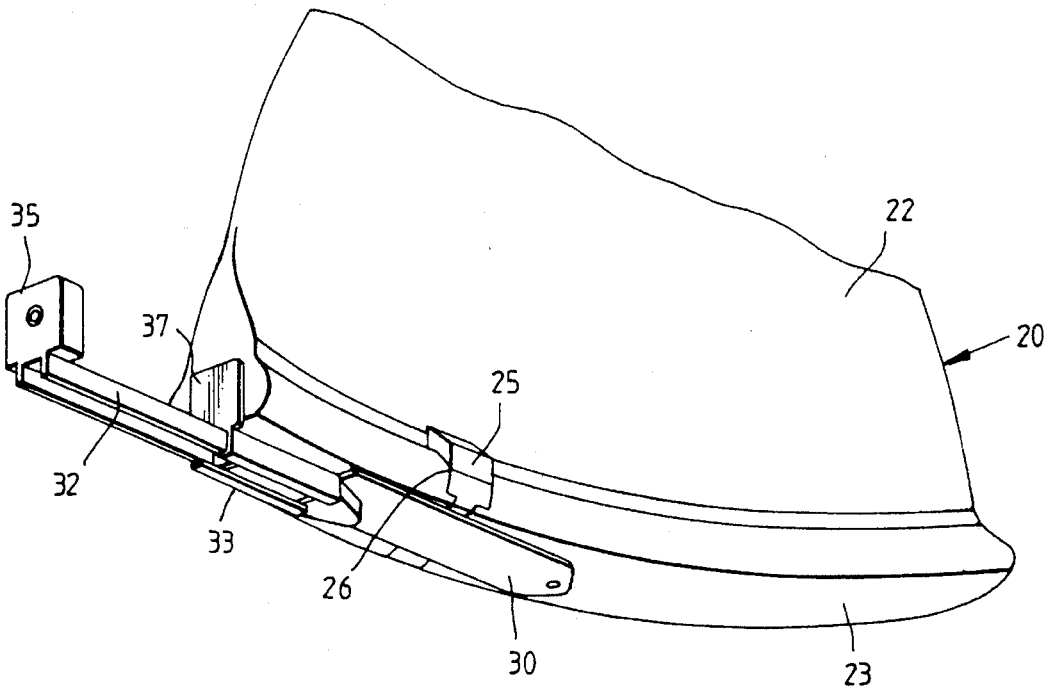
FIG. 2 is a view of the radially inward region of one of the fan blades of the ducted fan gas turbine engine shown in FIG. 1.
Figure 3:
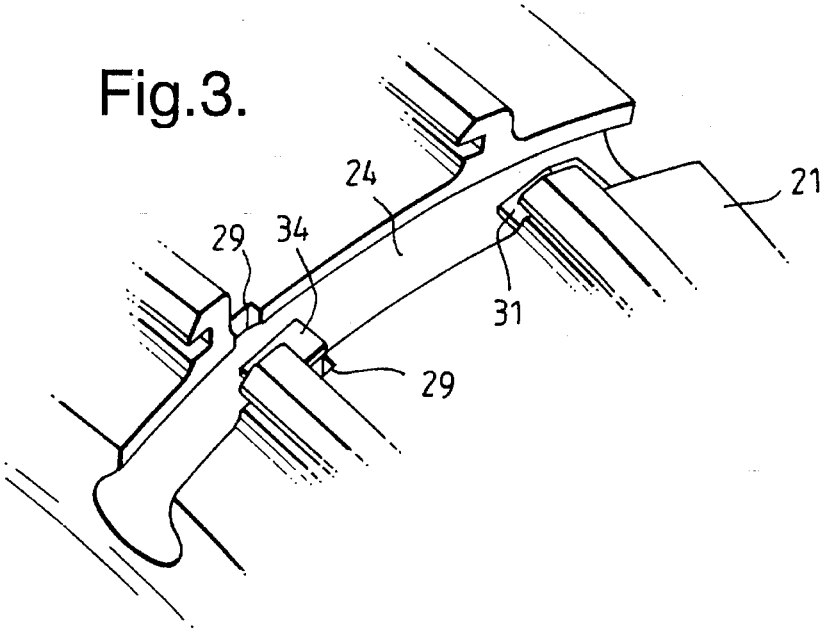
FIG. 3 is a view of one of the grooves in the hub of the fan blade assembly shown in FIG. 1 for receiving the fan blade shown in FIG. 2.

The fan blade assembly 12 comprises an annular array of radially extending fan blades, part of one of which 20 can be seen in FIG. 2, which are located upon a hub 21, part of which can be seen in FIG. 3.

Each fan blade 20 comprises an aerofoil portion 22 and a root portion 23. The root portion 23 is of approximately dovetail cross-sectional configuration. A plurality of generally axially extending grooves 24 of corresponding cross-sectional configuration are provided in the hub 21 to receive the root portions 23. It will be seen therefore that when the fan blade root portions 23 are located in their corresponding grooves 24 in the hub 21, they are radially anchored.

Figure 11:
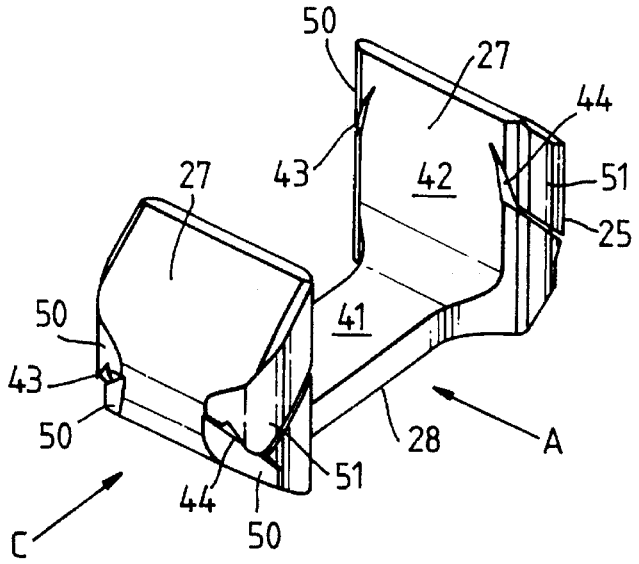
FIG. 11 is a view of a key in accordance with the present invention which provides axial locking of the fan blade in its corresponding hub groove.

Axial location of each fan blade root portion 23 in its corresponding hub groove 24 is provided by a key 25 which, as can be seen in FIG. 11, is of generally U-shaped configuration. The key 25 locates in generally radially extending slots 26 provided in the fan blade root portion 23. One slot 26 is located each side of the root portion 23 so that each slot 26 receives one arm 27 of the key. A further circumferentially extending slot (not shown) is provided in the base of the root portion 23 to receive the bridging piece 28 of the key 25 which interconnects its arms 27.

The groove 24 in the hub 21 which receives the fan blade root portion 23 is, as can be seen in FIG. 3, also provided with two generally radially extending slots 29 in its radially outward region. The axial extent of each of the hub slots 29 is approximately equal to the thickness of the arms 27 of the key 25. When the fan blade root portion is correctly positioned within the fan hub 21, the slots 26 and 29 in the root portion 23 and hub groove 24 respectively are radially aligned. This permits the arm 27 of the key 25 to simultaneously locate in the root slots 26 and hub groove slots 29. As a consequence of this, the fan blade root portion 23 is prevented by the key 25 from translating axially relative to the hub 21.

Although in the case of the present invention a single key 25 is associated with each fan blade root portion 23 it will be appreciated that under certain circumstances it may be desirable to provide each fan blade root portion with two or more of the keys 25.

Figure 4:
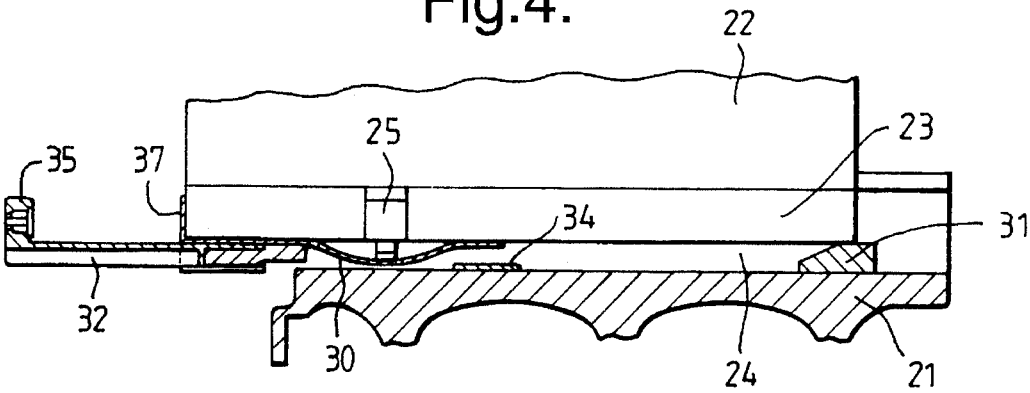
FIG. 4 is a sectioned side view of the fan blade shown in FIG. 2 being assembled into the hub groove shown in FIG. 3.

Referring to FIG. 2, when the fan blade 20 is not in place on the hub 21, the key 25 is held in place in the slots 26 in the root portion 23 by a flat leaf spring 30. The spring 30 is made from spring steel although other suitable resilient materials such as rubber could be used, and is attached to the underside of the root portion 23 so as to engage the bridging piece 28 of the key 25. As can be seen in FIG. 4, the key may be manually depressed radially inwardly against the resilience of the spring 30. When the key 25 is so depressed, the fan blade root portion 23 can be fed into the hub groove 24. In order to accommodate key 25 and spring 30 when so depressed, the hub groove 24 is deeper than the fan blade root portion 23. When the root portion 23 has been fully fed into the hub groove 24, the slots 26 and 29 become aligned, so permitting the key 25 to be urged by the spring 30 into the groove slots 29. This, as stated earlier, axially locks the fan blade root portion 23 relative to the hub groove 24.

In order to ensure that each of the fan blade root portions 23 is properly located within its hub groove 24, an inclined step 31 is provided at the downstream end of the hub groove 24 to support the downstream end of the fan blade root portion 23. Additionally a removable support 32 is provided at the upstream end of the hub groove 24. The removable support 32 is slidably retained within a support member 33 which is located at the upstream end of the fan blade root portion 23. In the present embodiment, the support member 33 is defined by an extension of the spring 30. However, it will be appreciated that the support member 33 need not be part of the spring 30 if so desired.

Figure 5:
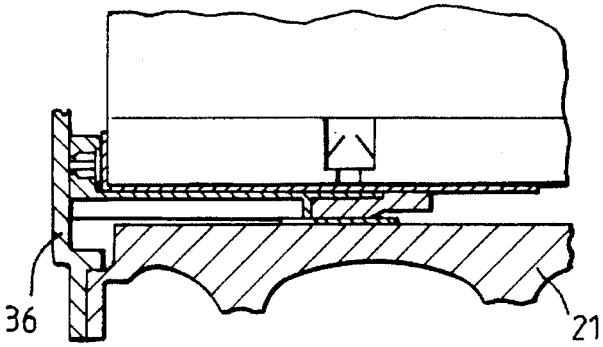
FIG. 5 is a sectioned side view similar to that shown in FIG. 4 but showing the fan blade fully located within its corresponding hub groove.

In addition to providing correct location of the upstream end of the fan blade root portion 23, the removable support 32 also functions as a lock to lock the key 25 in position. It does this by bridging the gap between the underside of the spring 30 and the bottom of the hub groove 24 as can be seen in FIG. 5. A rubber pad 34 is located on the bottom of the hub groove 24 to engage the removable support 32, thereby ensuring a tight, vibration-free fit for the removable support 32 and preventing blade movement during windmilling of the fan blade assembly.

The upstream ends of the removable supports 32 are modified to define stops 35 which engage extensions 37 of the springs 30 which themselves abut the upstream face of the fan blade root portion 23. A lightweight cover plate 36 which is attached to the upstream face of the hub 21 engages the stops 35, thereby maintaining the removable supports 32 in position against the spring extensions 37.

The removable supports 32 facilitate easy insertion of the root portions 23 into and removal from their associated hub grooves 24. When the removable supports 32 are in place, they ensure that the root portions 23 are a tight fit within the hub groove 24. However when they are removed, the root portions 23 can be easily slid out of the hub groove 24 without any danger of jamming.

Under normal operating conditions, the key 25 is highly effective in locking each fan blade root portion 23 within its corresponding hub groove 24. However, if one of the fan blades 20 is impacted by a large foreign object, such as a heavy bird, the axial loading imposed upon its associated key 25 is increased considerably. If reference is now made to FIGS. 7 and 8, the effect of this increased loading can be seen.

Figure 7:
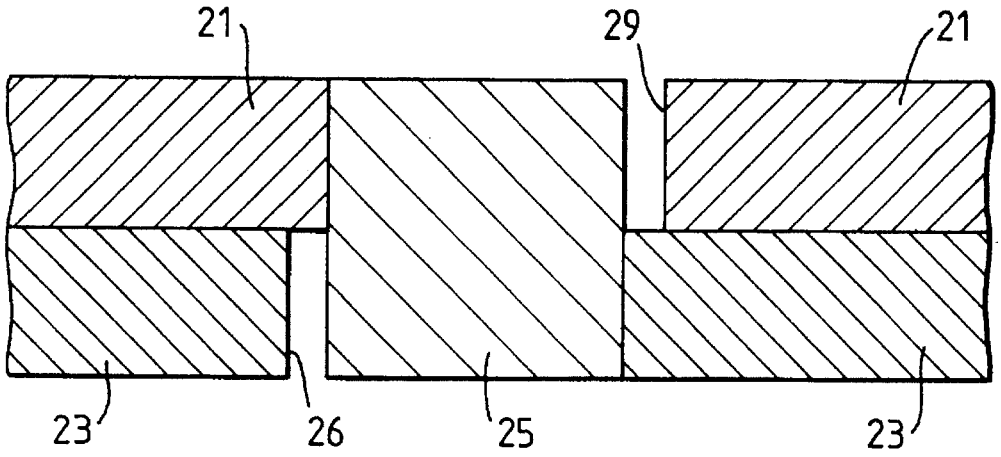
Fig.7. PRIOR ART
FIG. 7 is a schematic view of the key shown in FIG. 6 in place in the slots of a fan blade root portion and its corresponding hub groove.

FIG. 7 shows the relationship between the key 25 and the slots 26 and 29 in the fan blade root portion 23 and hub 21 respectively under normal operating conditions. The clearances between the key 25 and the slots 26 and 29 have been exaggerated however in order to illustrate the way in which the key 25 functions. The fan blade root portion 23 exerts an axial load upon the key 25 and the key 25 resists this load in shear through its cooperation with the hub 21.

Figure 8:
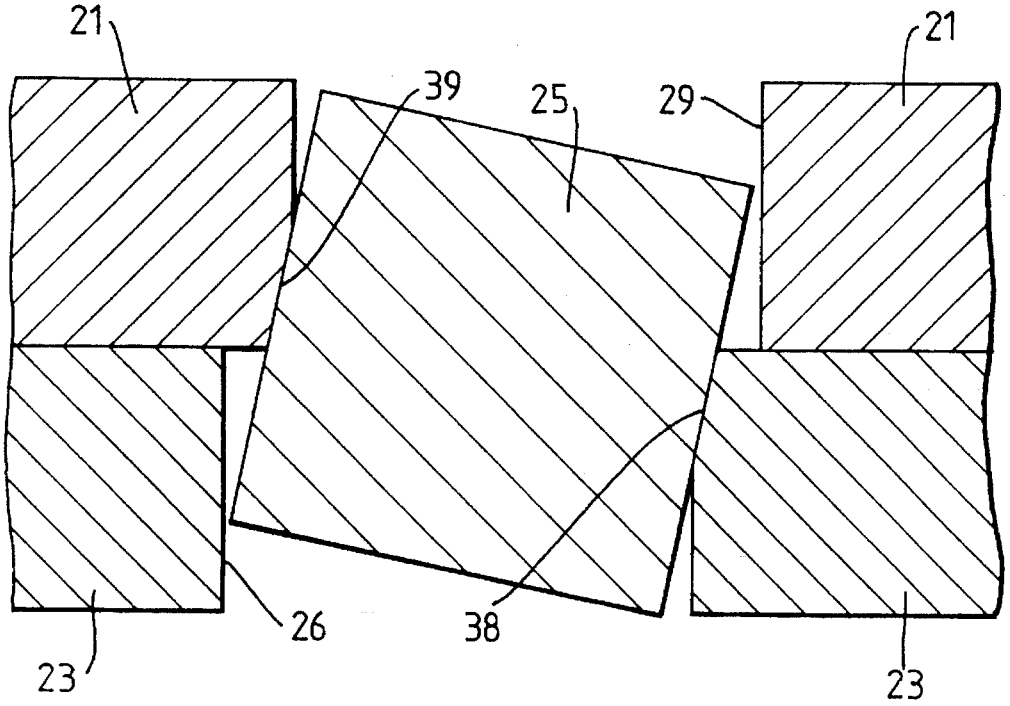
Fig.8. PRIOR ART
FIG. 8 is a view similar to that shown in FIG. 7, although on a larger scale, showing the movement of the key during excessive axial loading of the fan blade.

In the event that the fan blade 20 is impacted by a foreign object, the resultant axial loads imposed upon the key 25 cause the key 25 to rotate by a small amount to the position shown in FIG. 8. Thus the key 25 still continues to provide axial retention of the fan blade root portion 23 in its corresponding hub groove 24. However the limited rotation of the key 25 results in damage at positions 38 and 39 to the key 25, the hub 21 and the fan blade root portion 23. The key 25 may be considered to be a disposable item and so damage to it is acceptable. However, the hub 21 is very expensive to manufacture and therefore any severe damage to it by the key 25 must be viewed as being extremely undesirable.

Figure 6:
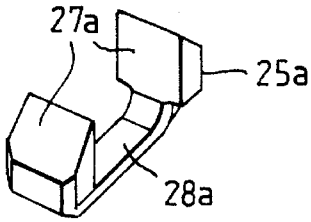
Fig.6. PRIOR ART
FIG. 6 is a view of a key of prior art design to provide axial locking of the fan blade in its corresponding hub groove.
Figure 9:
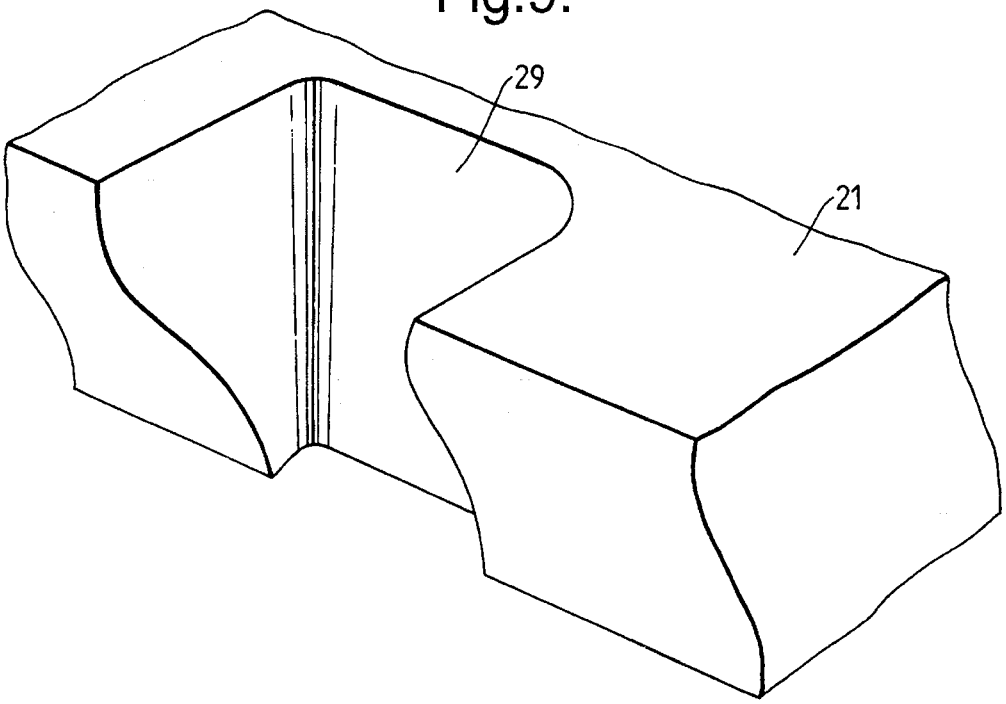
FIG. 9 is a view on an enlarged scale of a slot in the hub groove shown in FIG. 3.
Figure 10:
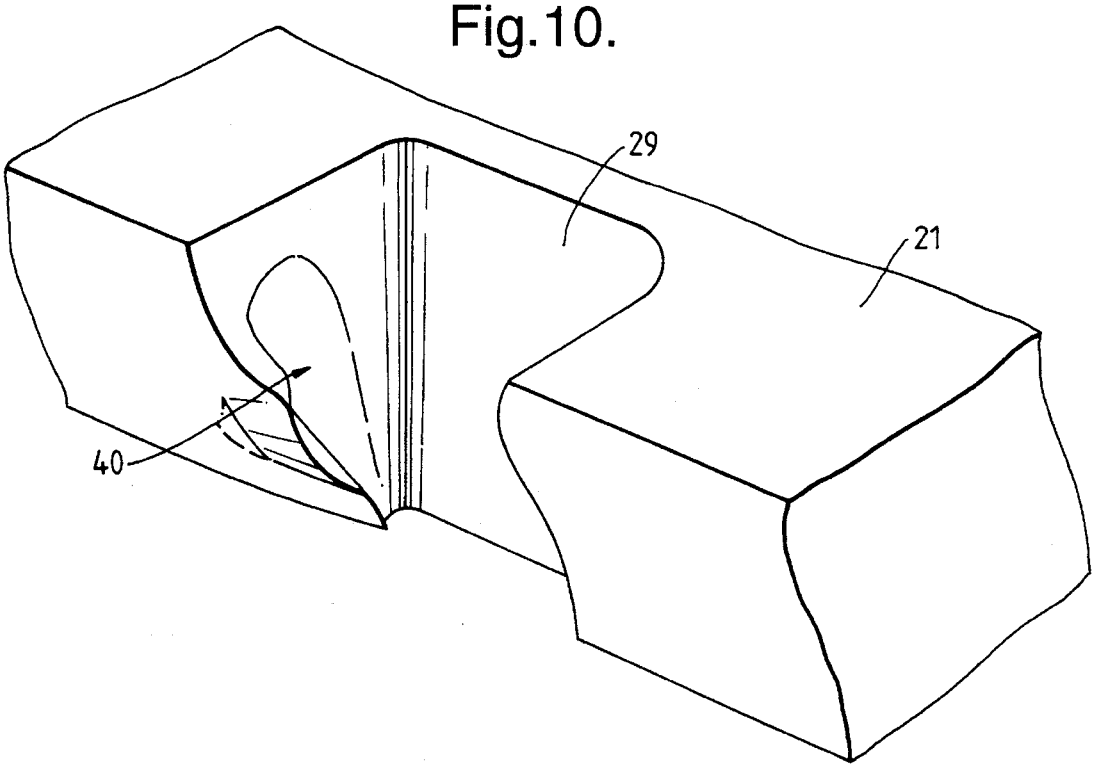
FIG. 10 is a view similar to that shown in FIG. 9 in which the slot has been damaged as a result of excessive axial loading of the fan blade which locates in the hub groove.

FIG. 9 shows on an enlarged scale one of the slots 29 in the hub 21 prior to any damage being incurred by that slot. FIG. 10 shows the same slot 29 after it has been damaged by a prior art key 25*a* of the type shown in FIG. 6. The parts of the key 25*a* which correspond with those of the key 25 in accordance with the present invention are suffixed by the letter "a".

It will be seen from FIG. 10 that the prior art key 25*a* causes considerable damage at 40 to the side wall and edge of the slot 29. Such damage places undesirable stress and fatigue limitations on the hub 21 and could lead to it being scrapped.

Figure 12:
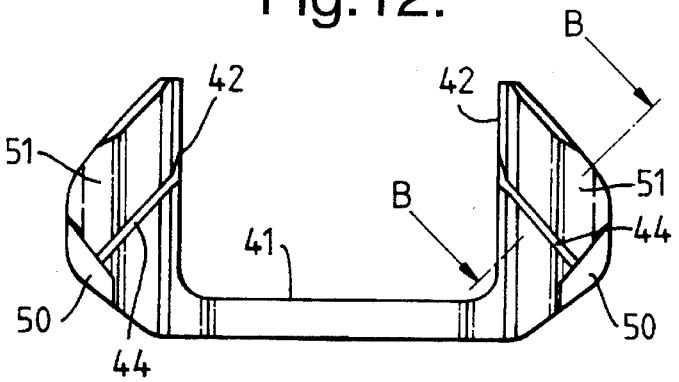
FIG. 12 is a view on arrow A of FIG. 11.

In accordance with the present invention, such undesirable damage to the hub 21 is substantially reduced by the use of a key 25 which is subject to deformation when shear loads of the kind described above are imposed upon it. Referring to FIGS. 11 and 12, the key 25 is generally similar in configuration to the prior art key 25*a*. It comprises two similar generally parallel arms 27 which are spaced apart by a bridging member 28. The bridging member 28 defines a flat surface 41, and the arms 27 define two confronting flat surfaces 42 normal to the bridging piece flat surface 41, all of which are adjacent to the fan blade root portion 23.

Each arm 27 of the key 25 is provided with two similar slits 43 and 44 on its axially forward and rearward regions respectively.

Each slit 43 and 44 is inclined at an angle of approximately 45° to the plane of the flat surface 41 of the bridging piece 28 when viewed in the axial direction A. Additionally each pair of downstream slits 44 is of convergent configuration in a radially outward direction when viewed in the axial direction A and the upstream and downstream slits 43 and 44 on each arm 27 are also of convergent configuration in a radially outward direction when viewed in the circumferential direction C. The slits 43 and 44 serve to define cantilevered key portions 50 and 51 respectively.

Figure 13:
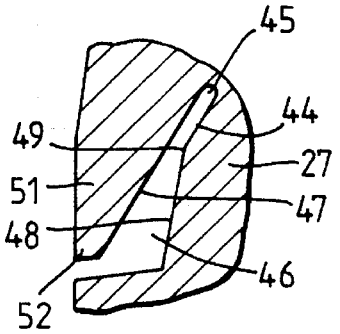
FIG. 13 is a view on section line B—B of FIG. 12.

Each of the slits 44 has the cross-sectional configuration which can be seen in FIG. 13. The slits 43 are of the same cross-sectional configuration as the slits 44 and function in the same manner. Each slit 44 comprises two portions: a first portion 45 which is of constant width and a second portion 46 which is divergent.

One side 47 of the slit 44 is planar in both of the portions 45 and 46. However, the other side 48 comprises two angled faces which are divided by an edge 49 to thereby define the divergent slit portion 46.

Figure 14:
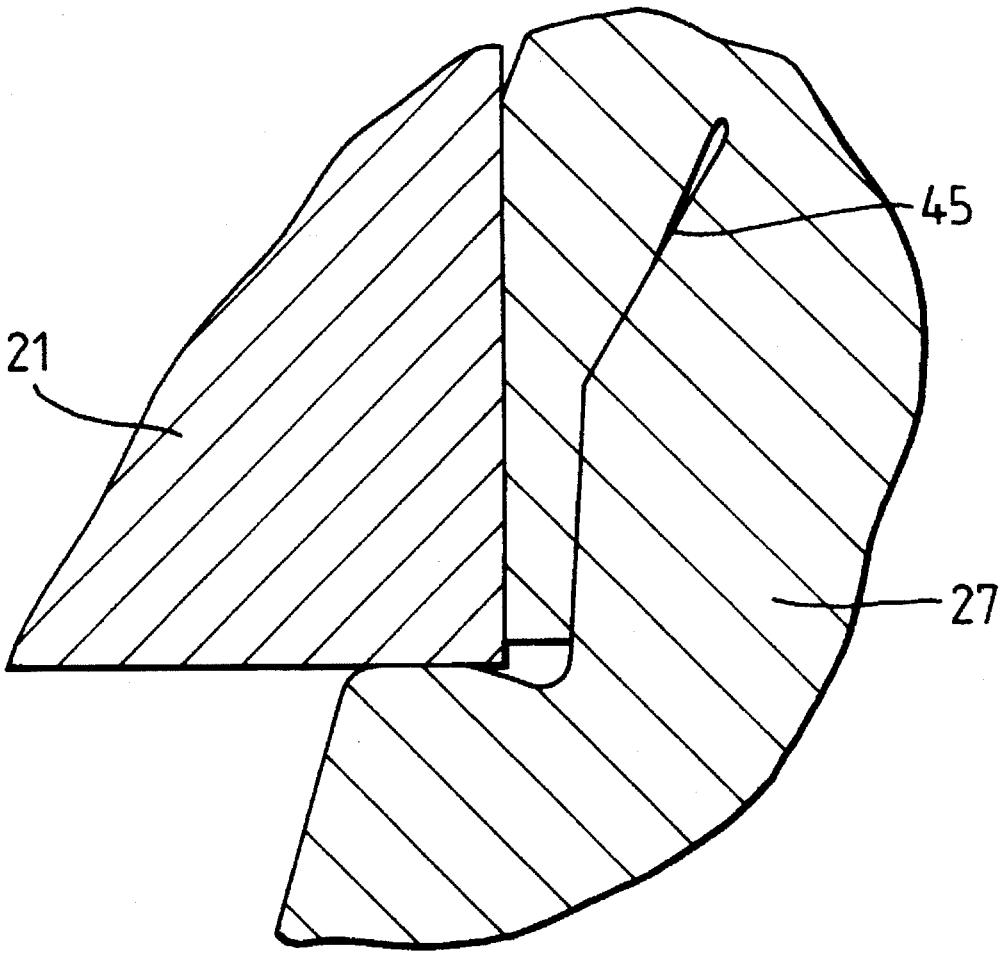
FIG. 14 is a view similar to that shown in FIG. 13 which shows the key after deformation.

In the event of one of the fan blades 20 being impacted by a large foreign object and the key 25 rotating in the manner described earlier, the slits 44 on the affected part of the key 25 collapse due to the deformation of their associated cantilevered portions 51. The collapse of the slits 44 occurs in two parts. Firstly the constant width slit portion 45 of each slit 44 collapses to bring the planar side 47 of the slit 45 into engagement with the edge 49. Then the divergent slit portion 46 progressively collapses until the slits 44 have almost completely collapsed as shown in FIG. 14. The divergent configuration of the second slit portion 46 thereby permits the progressive deformation of the cantilevered key portions 51, collapse of the slit 44 and the limited rotation of the key 25. There are three major benefits which result from this. Firstly the position of maximum force exerted by the cantilevered key portion 51 on the hub 21 is moved away from the free end 52 of the cantilevered key portion. The cantilever free end 52 does not therefore exert a potentially damaging high force on the hub 21. Secondly the deformation of the cantilevered key portion 51 absorbs energy. Thirdly the deformation of the cantilevered key portion 51 also causes it to conform to the shape of the part of the hub 21 which is adjacent to it. Consequently the area of contact between the key 25 and the hub 21 is maximised.

These benefits combine to ensure that the damage which the key arm 27 inflicts upon the hub 21 is greatly reduced when compared with that inflicted by the prior art key 25*a*.

In the event of large foreign object impact by one of the fan blades 20, there tends to be movement of its root portions 23 in both axially upstream and downstream directions. The provision of four slits 43 and 44 on each key 25 ensures that there is appropriate key 25 deformation during movement in both of these directions.

It is envisaged that in order to fully minimise damage to the hub 21, portions of each key 25 which define potentially damaging edges could be removed if their removal does not have a prejudicial effect upon the operation of the key 25. The chamfered regions 50 shown in FIGS. 11 and 12 are typical of areas in which such portions have been so removed.

The present invention therefore provides a gas turbine engine fan blade assembly 12 in which damage to the hub 21 of the assembly is minimized in the event of foreign object impact by one or more of its fan blades 20.

We claim:

1. A fan blade assembly for a ducted fan gas turbine engine comprising a hub, an annular array of fan blades extending radially outwardly from said hub, said hub having a plurality of generally axially extending grooves in its periphery and each of said fan blades having a root portion which locates in one of said generally axially extending grooves in said hub periphery, each of said fan blade root portions and said hub being provided with generally radially extending slots, each slot in said hub being aligned with a corresponding slot in its associated fan blade root portion, and key means, said key means being located in said aligned slots to limit relative axial movement between each of said fan blade root portions and its corresponding hub groove, each of said key means defining at least one collapsible slit so configured as to collapse under excessive axial loading of its associated fan blade to thereby minimize any resultant damage by said key means to its associated hub slot.

2. A fan blade assembly as claimed in claim 1 wherein each of said key means is of generally U-shaped configuration, the arms of said U-shaped key means being located in said aligned slots, each of said arms defining at least one of said collapsible slits configured to deform under said excessive fan blade loading.

3. A fan blade assembly as claimed in claim 2 wherein said at least one slit comprises a first portion which is of generally constant width and a second portion which is of divergent configuration.

4. A fan blade assembly as claimed in claim 3 wherein one side of said at least one slit is generally planar.

5. A fan blade assembly as claimed in claim 2 wherein each arm of said U-shaped key means is provided with two of said slits, one on the upstream portion of said arm and the other on the downstream portion of said arm.

6. A fan blade assembly as claimed in claim 5 wherein each pair of said slits on the upstream and downstream portions of said arms on each of said key means are-of convergent configuration when viewed in both axial and circumferential directions.

7. A fan blade assembly as claimed in claim 1 wherein each of said fan blade root portions is of approximately dovetail cross-sectional configuration.

* * * * *